United States Patent [19]

Micallef

[11] Patent Number: 4,674,659

[45] **Date of Patent: * Jun. 23, 1987**

[54] UNIVERSAL SEQUENTIAL DISPENSING PUMP SYSTEM

[75] Inventor: Lewis A. Micallef, Fort Lee, N.J.

[73] Assignee: Leeds and Micallef, Fort Lee, N.J.

[ * ] Notice: The portion of the term of this patent subsequent to Feb. 16, 1999 has been disclaimed.

[21] Appl. No.: 347,806

[22] Filed: Feb. 11, 1982

Related U.S. Application Data

[63] Continuation-in-part of Ser. No. 899,268, Apr. 24, 1978, Pat. No. 4,315,582.

[51] Int. Cl.[4] ..... B05D 11/00

[52] U.S. Cl. ..... 222/148; 222/321; 222/383; 239/333; 417/498

[58] Field of Search ..... 222/321, 380, 383, 148; 239/329, 331, 333; 92/242, 243, 253; 417/498

[56] References Cited

U.S. PATENT DOCUMENTS

| | | | |
|---|---|---|---|
| 1,164,754 | 12/1915 | Rose | 222/383 X |
| 1,301,229 | 4/1919 | Coker | 222/380 |
| 1,951,910 | 3/1934 | Heffner et al. | 222/380 |
| 2,008,427 | 7/1935 | Vezina | 222/380 X |
| 2,283,529 | 5/1942 | Bobrick | 222/321 |
| 3,187,960 | 6/1965 | Gorman | 222/383 X |
| 3,266,384 | 8/1966 | Scaramucci | 92/242 |
| 3,379,381 | 4/1968 | Decaux | 222/383 X |
| 3,393,844 | 7/1968 | Beres et al. | 222/533 |
| 3,464,323 | 9/1969 | Saksun | 92/243 |
| 4,072,252 | 2/1978 | Steyns et al. | 222/341 |
| 4,105,146 | 8/1978 | Broillard | 222/383 |
| 4,139,122 | 2/1979 | Bauer | 222/321 X |

*Primary Examiner*—Joseph J. Rolla
*Assistant Examiner*—Frederick R. Handren
*Attorney, Agent, or Firm*—Kane, Dalsimer, Kane, Sullivan and Kurucz

[57] ABSTRACT

A dispensing pump includes an outer cylinder and an inner piston which cooperate in defining a pump chamber. The cylinder includes an inlet port and an outlet port which are sequentially opened and closed by the piston. In addition, a vent for the container interior to replace discharge product with air is also adapted to be opened and closed incident to the movement of the piston. Sealing rings are provided between the piston and cylinder, the location of which, determines the amount of product and air drawn into the pump chamber as well as the characteristics of the dispensing pattern of the product discharged by the pump. During part of the suction stroke as well as the compression stroke, both the inlet and outlet ports are simultaneously closed by the piston thereby respectively creating a predetermined negative pressure and positive pressure within the pump chamber. A pin, separate from the discharge orifice is adapted to be shiftable into and out of the passageway leading from the pump chamber to the discharge orifice to respectively close and open this passage.

41 Claims, 19 Drawing Figures

FIG.1
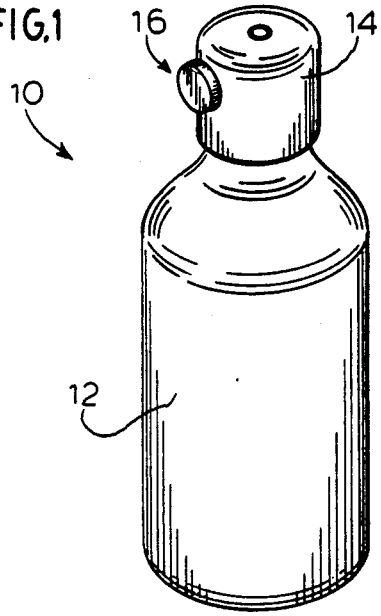
FIG.3
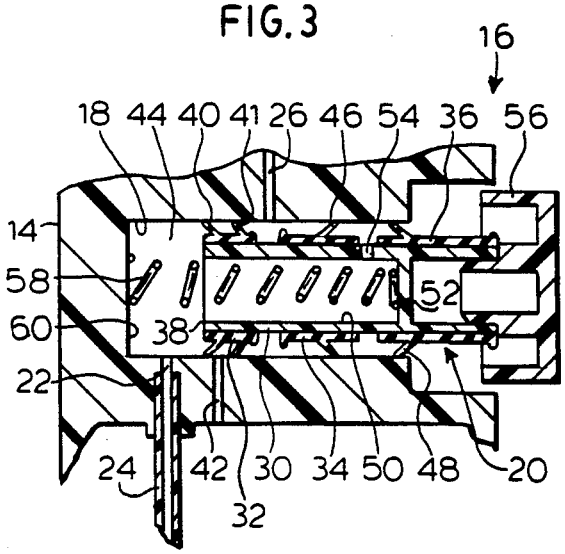
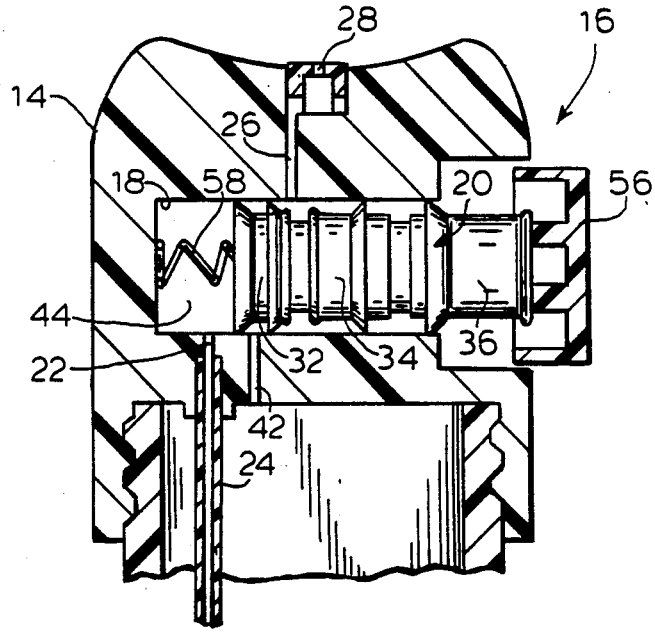
FIG.2

FIG.13
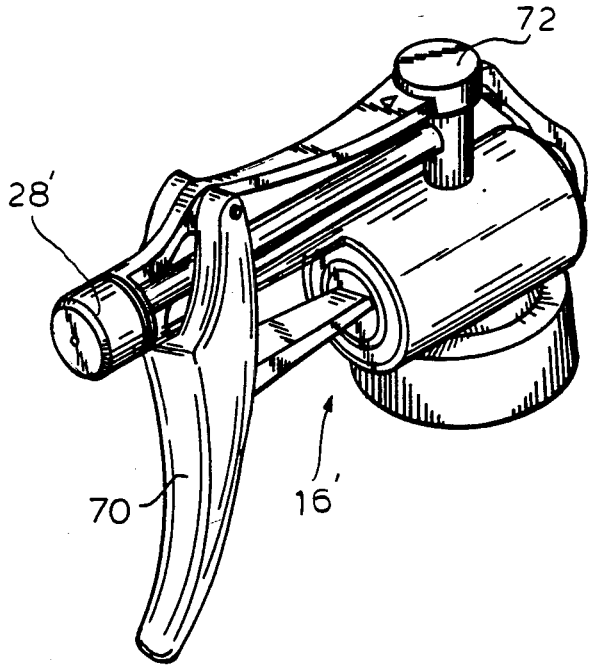
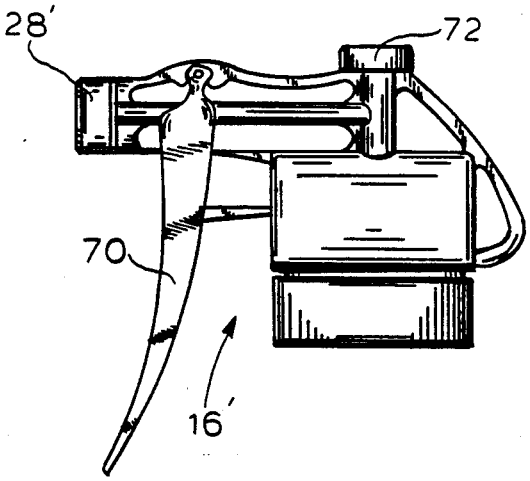
FIG.14

FIG.17
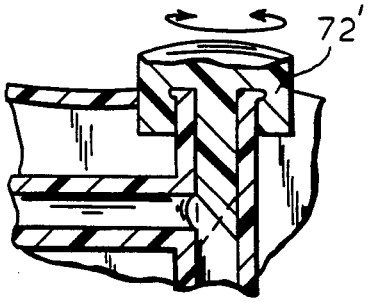
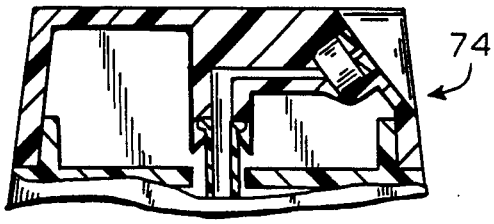
FIG.19
FIG.16
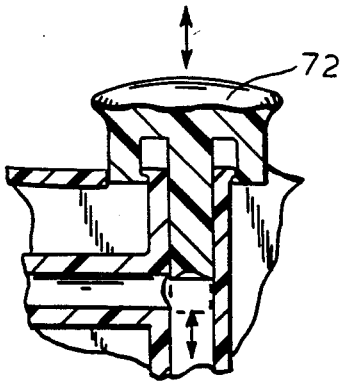
FIG.18
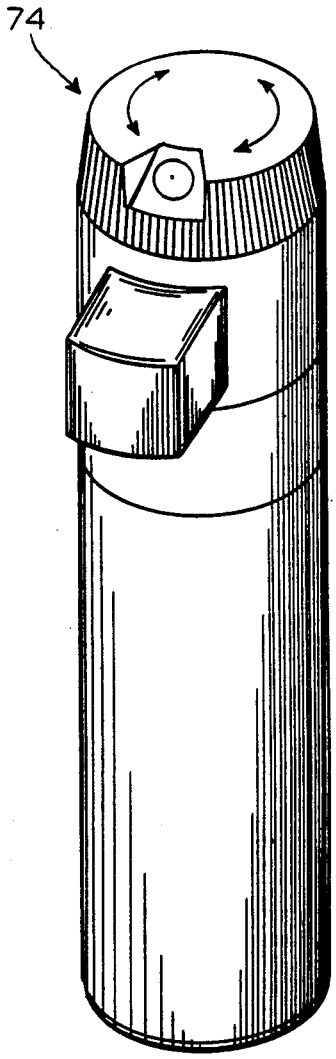
FIG.15
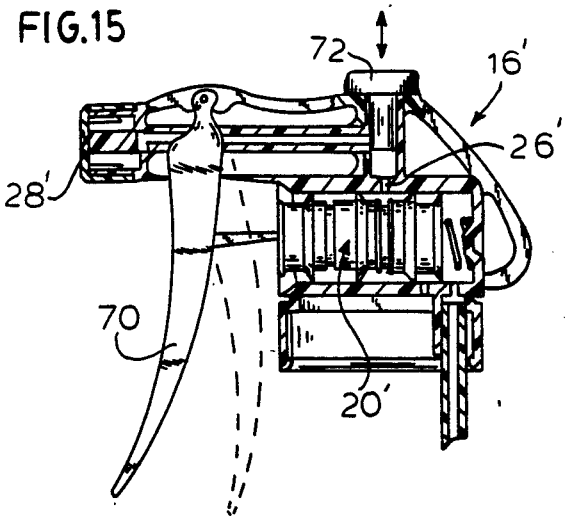

UNIVERSAL SEQUENTIAL DISPENSING PUMP SYSTEM

REFERENCE TO RELATED APPLICATION

This application is a continuation-in-part of application Ser. No. 899,268 filed Apr. 24, 1978 for a Universal Sequential Dispensing Pump System Free of External Check Valves and Having Venting Capability now U.S. Pat. No. 4,315,582 granted Feb. 16, 1982.

BACKGROUND OF THE INVENTION

I — Field of the Invention

This invention relates to a manually operated pump for dispensing the contents of a container.

II — Description of the Prior Art

A wide variety of dispensing pumps have found commercial acceptance for dispensing a product from a container. The typical pump includes a vertically reciprocal finger actuated plunger, that causes product to pass through a dip tube, enter a pump chamber and exit through a nozzle or outlet, according to the prescribed pumping cycle and predetermined opening and closing of both inlet and outlet valves.

Similarly, trigger actuated pumps gained in popularity with pumping being achieved by pressing and releasing a laterally disposed trigger mechanism.

Dispensing pumps of the prior art have been constructed to provide a fixed volume of product to be discharged per stroke. If a different volume per stroke was desired a new set of tooling for manufacturing the pump would be required which could be extremely expensive.

In addition, pumps of the foregoing type require a relatively larger number of complex parts with consequent expense both in manufacture and assembly. Thus, there exists a need fo dispensing pumps that are relatively simple and reliable with a substantially reduced number of parts, each individually simple and inexpensive to manufacture and assemble.

The need for reliable and less costly pumps for dispensing products, particularly, those that are petroleum based and/or chemically reactive with regard to the pump materials has increased; and it is become acute as pumps replace aerosol dispensing packages that are being withdrawn because of fluorocarbon propellants with their predicted effect on the environment. In addition, such criticism has served to make the consumer aware of the inherent economy and convenience of pump type dispensers.

While the pumps disclosed in the above referenced patent application provides an effective solution to solving the shortcomings of the prior art dispensing pumps, it remains a continuing desire of this industry to decrease manufacturing costs and upgrade the construction, performance and reliability, as well as enhance and widen the application of dispensing pumps for an ever-increasing variety of substances and materials with spray patterns heretofore sought but never achieved by pumps.

SUMMARY OF THE INVENTION

A principal object of this invention remains, as stated in the above-referenced application, which is to provide an improved system for manually actuating a dispensing pump which is comprised of a minimum number of parts, each individually simple to manufacture and assemble at relatively low cost; and this pump system may be constructed of essentially only two basic parts, only one of which moves, with other mostly conventional parts, being necessary to satisfy certain applications.

Another object is to provide an improved piston pump that is self-sealing in the rest position for shipment, is self-cleaning to prevent clogging of the discharge orifice, and may take advantage of variable air assist in discharging product. In this connection, lotions may be dispensed by practicing the teachings of this invention.

A further object is to provide a pump design that permits tailoring of the pump performance to the product needs to thereby provide a series of pumps without tooling changes or new tooling.

Still another object is to provide a streamline trigger pump that permits a wide variety of cover shrouds of one's choice.

A still further object is to provide several different pumps with different liquid volume to air volume ratios per stroke with a single set of tooling by changing location of the sealing rings relative to the inlet and outlet port means.

Other objects and advantages will become apparent from the following detailed description which is to be taken in conjunction with the accompanying drawings.

BRIEF DESCRIPTION OF THE DRAWINGS

FIG. 1 is a perspective view of a dispenser incorporating pump of this invention;

FIG. 2 is a fragmentary longitudinal sectional view of the dispenser of FIG. 1 illustrating detail of the pump, and together with an exemplary discharge orifice shown normal to the pump axis, but which may be oriented in any other direction relative thereto including parallel therewith;

FIG. 3 is another somewhat similar fragmentary sectional view, showing details of the piston of the pump at the start of the pumping cycle, at which the contents of the container are sealed from the ambient to provide a self-sealing shippable commercial dispenser;

FIG. 13 is a perspective view of a trigger pump incorporating the pump of this invention with the pump housing being streamlined to reduce plastic material;

FIG. 14 is a side elevational view thereof;

FIG. 15 is a longitudinal sectional view of the pump of FIGS. 13 and 14;

FIG. 16 is an enlarged sectional view of an axially shiftable shut off pin;

FIG. 17 is a similar enlarged sectional view of a rotatable shut of pin;

FIG. 18 is a perspective view of a pump of this invention in which a rotatable nozzle is provided to render the nozzle multidirectional; and FIG. 19 is an enlarged fragmentary longitudinal sectional view of the rotatable nozzle of FIG. 18.

DETAILED DESCRIPTION

Figure 4:
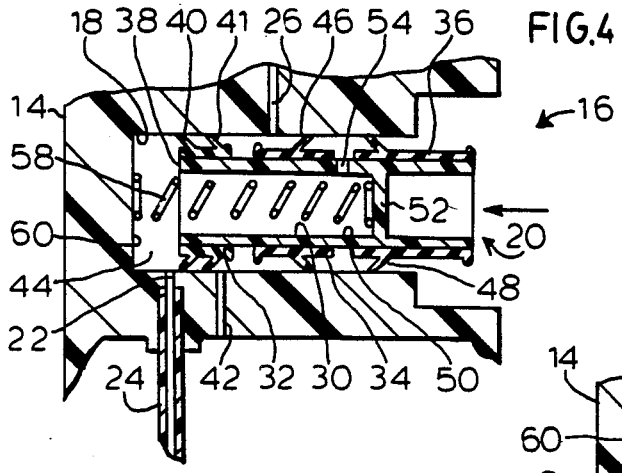
FIG. 4 is a similar sectional view showing the piston being advanced to a location short of the inlet port, but clearing the vent opening thereby providing communication between the head space of the container and the ambient.

Referring to FIG. 1, a dispenser package 10 is shown including a product or liquid containing bottle or receptacle 12, and an upper component retaining body or cap 14 containing the pump 16 of this invention.

Referring now to FIG. 2, the pump 16 includes a cylinder 18 and a piston 20. The cylinder includes an inlet port 22 which communicates with a downwardly depending dip tube 24. In addition, the cylinder 18 includes an outlet port 26 which may have coupled therewith a discharge orifice 28 extending in an upward direction for convenience in cosmetic applications.

The piston 20 is advantageously provided with a series of annular sealing or contact rings that move along the interior surface of the cylinder 18. The clearance between the piston 20 and particularly its rings and the interior walls of the cylinder 18 shall be minimized to obtain the maximum effficiency of the pump 16. Towards this end, and in order to optimize the manufacture of the piston 20 at a reduced cost, these rings are advantageously part of a slidable sleeve adapted to be telescoped over and suitably secured to the piston tubular ring support 30 (see FIG. 3). Thus, in the disclosed embodiment, three ring sleeves 32, 34 and 36 are disclosed which are made of a suitable resinous material, preferably a flexible, elastomeric material, having compatibility with the product to be dispensed. The tubular support 30, is preferably made of a relatively hard resinous material, also having compatibility with the product to be dispensed. At the leading or inner end 38 of the piston is positioned a first ring sleeve 32, having extending therefrom sealing ring 40 inclined forwardly and in the direction of compression so as to resist any tendency to collapse during the pressure stroke. As will be explained in detail, sealing ring 40 will operate to isolate and seal off the inlet port 22 from the vent opening 42, outlet port 26 and the pump chamber 44. A ring 41 may be located at the inner end of the piston and may extend from ring sleeve 32 for purposes of isolating the vent opening 42 from the outlet port 26 when the piston 20 is at its rest position fully retracted in the cylinder 18 to seal the container and provide a shipper for commercial purposes. The intermediary ring sleeve 34 includes an outwardly extending ring 46 inclined in a rearward direction to seal the outlet port 26 from the pump chamber and the outlet port from the vent opening 42, respectively.

The rear ring sleeve 36 is provided with an outwardly extending forwardly inclined sealing ring 48 which seals the juncture between the rear end of the piston and the cylinder and also cooperates with the rearwardly inclined sealing ring 46 in isolating the outlet port 26 when in communication with the pump chamber 44. In this connection, the tubular support 30 is provided with the central coaxial bore 50 that opens at the piston forward end 38 into the pump chamber 44, and thereby provides an extension thereof. This bore 50 may be eccentrically located or be plural in number to obtain different discharge characteristics. For example if the bore is at the top center of the piston, more air will be discharged before liquid. If the bore is at bottom center, more product will be discharged before air. The rear of the piston is provided with an integral wall 52 that closes off the bore 50 at this location. A radial opening or passageway 54 in the tubular support 30 between the ring sleeves 34 and 36 serves to communicate the outlet port 26 with the bore 50 and pump chamber 44 during the pressure stroke. In order to facilitate the forward extension of the piston during the pressure stroke, a finger actuator button or trigger 56 may be employed, whereas to facilitate the retraction of the piston during the suction stroke, a spring 58 may be deployed and be biased against the wall 52 and the inner closed wall 60 of the cylinder. Needless to say, this spring 58 should be compatible with the product to be dispensed.

The sealing ring sleeves are pressed on to the tubular support 30 and may have a high interference fit or be fastened or adhered thereto in any appropriate manner. It is also contemplated that each ring 40, 41, 46 and 48 will be identical and mounted on its own identical sleeve for mounting on support 30. In this manner, the same mold cavity will produce any one of these ring and sleeve assemblies and, accordingly other tooling for such assemblies will not be required. This is particularly true if the rings are to be relocated to obtain different pump discharge and performance characteristics. It is further contemplated that no spacers will be necessary to keep the rings properly spaced. On the other hand, if this is not attainable, obviously spacers or other fixation means may be employed.

The rings and sleeves are preferably molded of high density polyethylene and have a thickness dictated by this material. Other materials, such as elastomeric grade vinyl, polypropylene or nylon may be used.

The proposed materials from which the other pump parts are made is preferably polypropylene. However, other more suitable and product compatable plastic materials may be employed for these parts and the rings and sleeves as well.

When the piston 20 is in its fully retracted or extended position in the cylinder 18 as shown in FIG. 3, outlet port 26 is isolated from the pump chamber 44 as well as inlet port 22 and vent opening 42. At this particular disposition of parts of the pump, coupled with the sealing action provided by the ring 48, any unintentional dispensing of product is prevented and thus may be used as a shipping position if so desired, with or without a release element for maintaining this position during shipment and storage. In order to describe the operation of the pump 16, it will be assumed that the pump is primed and the piston 20 has completed a suction stroke and that there is product in the pump chamber 44 and piston bore 50, together with a certain amount o air, the calculation of which will be explained in detail shortly. If it is desired to dispense product and particularly the contents of the pump chamber 44 and piston bore 50, the pump 16 is activated by applying finger pressure to the actuator or trigger 56. As the piston 20 moves inwardly into cylinder 18 to initially clear vent opening 42 to the position of FIG. 4, at which the outlet opening 26 and vent opening 42 communicate to vent the container head space and at which the forward sealing ring 40 is short of the inlet port 22, some product along with some air is forced back down the dip tube 24.

Figure 5:
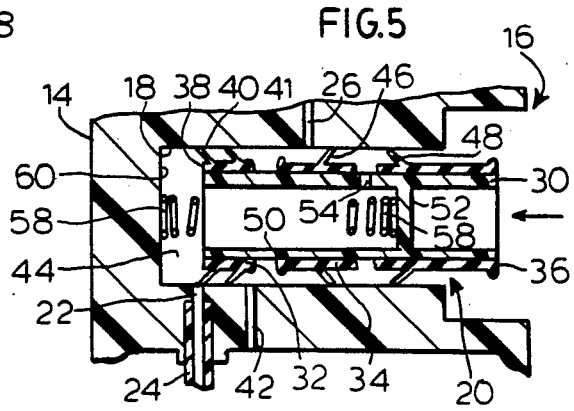
FIG. 5 is a similar sectional view showing the piston being further advanced past the inlet port communicating with the dip tube to thereby seal the inlet port while the outlet port remains closed for a predetermined length of travel of the piston.

As the piston 20 is moved forwardly and inserted into the cylinder 18, the position shown in FIG. 5 is reached. In this position, ring 40 will seal off inlet opening 22 and ring 46 will maintain outlet opening 26 closed. The extent of travel of piston 20 forwardly before outlet port 26 is cleared by ring 46 will determine the extent of pressurization of the contents of chamber 44 before discharge. As will be explained the volume of this displacement must be taken up by compressing air within the pump chamber.

Figure 6:
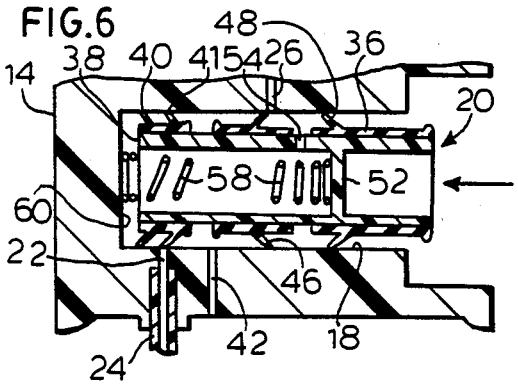
FIG. 6 is a similar sectional view showing the piston being further advanced with the outlet port opened to the pump chamber with the outlet port no longer in communication with the venting opening to thereby expel product.
Figure 7:
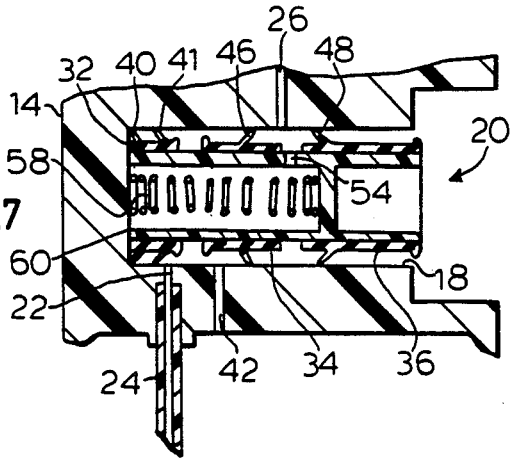
FIG. 7 is a similar sectional view showing the piston at the end of pressure cycle with the piston shown fully advanced.
Figure 8:
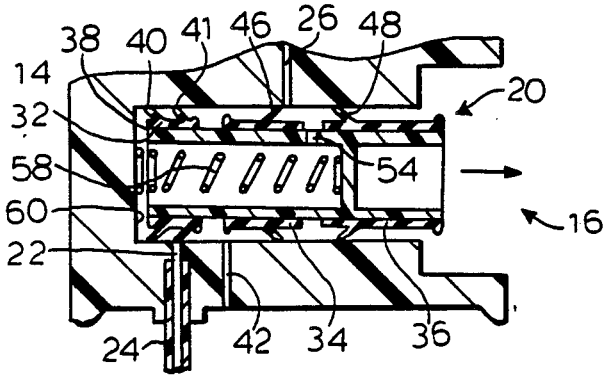
FIG. 8 is a similar sectional view showing the piston at the early stages of retraction, during which the inlet port is sealed and the outlet remains in communication with the pump chamber to thereby draw air into the pump chamber for mixture with product to be dispensed during the ensuing pressure stroke, at the same time cleaning the discharge orifice to minimize the tendency of clogging.
Figure 9:
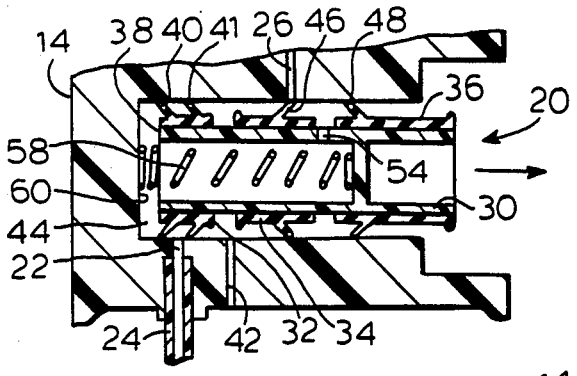
FIG. 9 is a similar sectional view showing the inlet and outlet ports closed which remains for a predetermined part of the travel of the piston during the retraction stroke.
Figure 10:
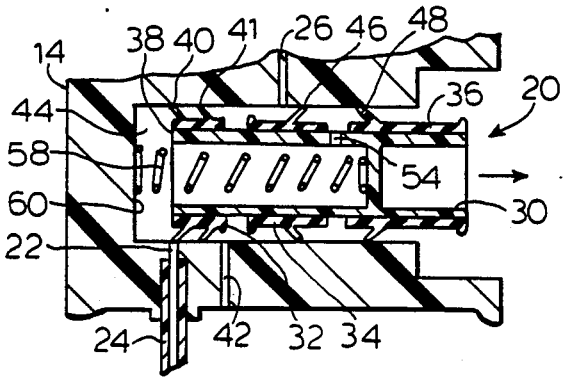
FIG. 10 is a similar sectional view with both the inlet and outlet ports sealed from the pump chamber, but the outlet port communicating with the vent opening to introduce air into the headspace of the container.
Figure 11:
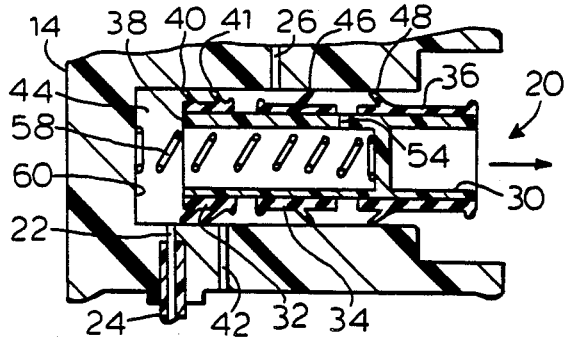
FIG. 11 is a similar sectional view with the piston retracted to clear the inlet port after a predetermined length of travel after the outlet port has been closed to expose the pump chamber to the contents of the container and permit negative pressure caused by piston movement to draw product up the dip tube into the pump chamber.

Further movement of the piston 20 to the postion shown in FIG. 6 permits sealing ring 40 to continue to close off the inlet port 22 from the pump chamber 44, which is now in communication with outlet port 26 as sealing ring 46 clears this port and communicates it with the space between this sealing ring and rear sealing ring 48 and the passageway 54 in the piston tubular support 30. Upon further insertion of the piston 20 in the cylinder 18, pressurization of the contents of the pump chamber 44 occurs to force product and air out of the pump chamber through the bore 50, passageway 54, port 26 out to the discharge orifice 28. Eventually the end of the pressure stroke is reached, as shown in FIG. 7 thereby ending the discharge of product out through the discharge orifice 28.

Figure 12:
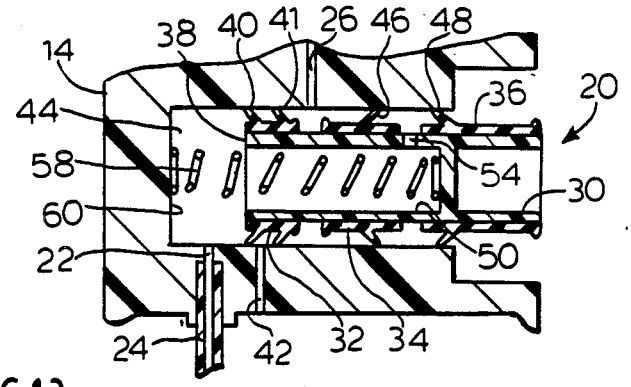
FIG. 12 is a similar sectional view showing the piston further retracted to seal off the outlet opening from the vent opening, at which the piston is disposed at the end of its retraction or suction stroke.

The initiation of the suction stroke in filling of the pump chamber 44 is shown in sequence in FIG. 7 to FIG. 12. During this portion of the cycle, air will be sucked into the discharge orifice 28 and the port 26 to flush these passageways and prevent clogging. The amount of air withdrawn into the pump chamber 44 may be predetermined in order to assure the desired dispersion of the product. Eventually, the disposition of the piston 20 within the cylinder 18 reaches that shown in FIG. 9, at which the forward sealing ring 40 still seals off the pump chamber 44 from the inlet port 22 and the intermediary sealing ring 46 has passed over and closes the outlet port 26 from the pump chamber 44 via the space between sealing rings 46 and 48 and the lateral piston passageway 54. Further retraction of the piston 20 creates a negative pressure in the pump chamber 44 until forward sealing ring 40 uncovers the inlet port 22. The volume of displacement before ring 40 uncovers inlet opening 22 generates a predetermined negative pressure. Upon the uncovering of opening 22, product will be sucked up into the pump from the dip tube 24 and inlet port 22 as a result of this negative pressure. Thus, the amount of product sucked into the pump chamber 44 will relate to the amount of piston travel after outlet port 26 is sealed off by ring 46 until ring 40 opens inlet port 22. In actual practice, during retraction of the piston 20 and because of the resistance to air flow mentioned in the above, there will be generated additional negative pressure that will be cumulative or additive during retraction of the piston when the outlet port 26 is opened and inlet port 22 is closed. It will be noted that sealing ring 41 at this point of travel is between the inlet port 22 and vent opening 42, which is now adapted to communicate with the outlet port 26 to thereby vent the container headspace and permit the introduction of air to replenish product removed from the container up through the dip tube 24 into the pump chamber 44 (see FIG. 11). As the piston 20 is retracted further, more product will be pulled up through the dip tube 24 from the container because of the negative pressure or suction created in the pump chamber 44 to draw product therein. Most if not all of this additional product will be forced back into the dip tube 24 during the compression stroke until ring 40 seals off the inlet port 22. At the end of the retraction stroke of the piston 20, as shown in FIG. 12 the vent opening 42 will be sealed from the outlet port 26 and product will be drawn into the pump chamber 44.

The pump filling cycle and product dispensing cycle may then be repeated as often as desired following the foregoing sequence of steps of operation, with pump 16 remaining primed after initial priming.

In designating a pump of this invention, the cylinder outlet port 26 should be connected to the space between rings 46 and 48, and thus through the piston passage 54 to the pump chamber 44. At the start of the intake stroke the cylinder inlet port 22 at this time should be located so as to be between rings 40 and 46, which seal it off from communication to the cylinder outlet port 26. At the start of the intake stroke and until the cylinder outlet port 26 is shut off by the passing of piston ring 46, air will be drawn into the pump chamber 44. When piston ring 46 passes the outlet port 26 no further air can enter the pump chamber 44 and the continued motion of the piston results in a pressure drop within the cylinder chamber 44 until piston ring 40 passes over the cylinder inlet port 22. Only when piston ring 40 passes the cylinder inlet port 22 can liquid flow into the cylinder. The amount of liquid will of course depend upon the relationship between the hydraulic resistance, the driving force and time. When the piston 20 reaches the end of the intake stroke it then begins the exhaust stroke at which time material in the cylinder 18 will be forced to return through the cylinder inlet port 22 until it is reclosed by piston ring 40. This further piston travel results in compression of the material inside the cylinder until piston ring 46 passes the cylinder outlet port 26 when material can leave the cylinder 18 until the piston 20 reaches the end of its compression and the cycle begins again.

During the intake stroke the volume of air that can enter the cylinder is equal to the cross-sectional area of the bore of the cylinder 18 times the distance between the piston ring 46 and the cylinder outlet port 26 measured at the start of the intake stroke. As will be explained, this is theoretical because in actual practice there will be resistance to air flow because of the size, length and diameter of the outlet passages. The amount of liquid that can be pumped into the cylinder per stroke is equal to the cylinder bore cross-sectional area times the piston stroke length minus the air take in. The amount of liquid available for discharge is equal to the liquid that was actually drawn in minus the amount returned as the exhaust stroke started and continuing until the inlet port was closed by ring 40. The dynamics of the pump's operation will always tend to make liquid intake fall short of theory.

In this connection, a factor which must be considered in the pump design is the effect of air resistance during the air intake phase of the cycle. If there is any significant resistance to air flow into the cylinder 18 during that part of the intake stroke, then, when the outlet port 26 is closed there will be a residual negative pressure in the cylinder 18. This negative pressure will be added to the suction developed to draw in liquid and thus alter the air liquid ratio. The magnitude of the effect must be measured before finalizing the dimensions of any given pump if it is to meet a specific target.

The liquid to air ratio is variable over a wide range. This may be accomplished by mere movement of ring 46. However, in actual practice this ratio is influenced by the resistance to air flow between the discharge orifice 28 and pump chamber 44. For example, the length of the passage between these locations and the diameters thereof as well as the size of the orifice 28 and inlet 22 must be considered. It is important that enough air is taken into the pump chamber 44 during the suction stroke to provide enough compression during the pressure stroke while both inlet port 22 and outlet port 26 are closed before ring 46 uncovers outlet port 26. In other words, there must be sufficient compressibility of the contents of pump chamber 44 to permit ring 46 to travel forwardly before opening the outlet port 26. Thus, there must be air for compressing in the pump chamber 44 that exceeds the volume of displacement incident to piston travel after inlet port 22 and outlet port 26 are both closed and until outlet port 26 is opened. Stated another way, there must be an air volume in pump chamber 44 greater than the volume displaced by the piston travelling forwardly after inlet port 22 is closed and until outlet port 26 is opened.

With favorable location of the inlet port 22 the performance of the pump 16 under ideal conditions, depends upon the effective stroke length and the way that length is allocated to the periods when the outlet port 26 is open or closed. For example, during the intake stroke if the outlet port 26 is closed during most of the stroke then the cylinder 18 will contain mostly liquid by the end of the stroke. Conversely, if the outlet port 26 is opened during the greater portion of the intake stroke, the contents will be mostly air at the stroke end. Between these extremes of mostly air or mostly liquid lie the practical mixtures that the pump 16 will deliver. The pump 16 employs the same portion of the stroke to suck in liquid on intake that it uses to compress the contents during the compression stroke.

In designing pumps it is useful to distinguish between real and effective stroke. The real stroke can continue after the piston 20 has passed the inlet port 22, but most if not all, the liquid that is drawn into the cylinder by the piston 20 travelling beyond the inlet port 22, will be returned to the container before the inlet port 22 is closed during compression. The effective stroke is the distance travelled by the piston 20 from the beginning of the intake stroke until the inlet port 22 is just reached by the ring 40.

The distance from ring 40 to the inlet port 22 during the suction stroke after outlet port 26 has been closed, controls the amount of product available to be discharged by the pump 16. The air to liquid ratio is a function of the distance travelled by ring 46 until the outlet port 26 is closed following the initiation of the intake stroke. The liquid volume is determined by the additional movement of ring 47 until the end of the intake or suction stroke is reached. Adjusting the location of ring 40 alters the volume to be returned to the inlet port 22 upon starting the compression stroke. Moving ring 46 alters the air/liquid ratio and the maximum pressure as previously stated but not the total volume. Ring 48 acts as an external seal only, therefore its position is variable so long as it does not cross the outlet port 26.

In all pump designs the inlet port 22 should be located close to one stroke length from the closed end of the cylinder. Some compromise may be necessary to provide for short strokes by the users.

At the end of the discharge stroke and beginning of the intake stroke as shown in FIG. 7, the minimum distance between rings 40 and 46 is the same as the distance from ring 40 to the inlet port 22 plus the diameter of the inlet port 22 plus allowance for short stroke. The minimum distance between rings 46 and 48 is the same as the distance from ring 46 to the outlet plus the diameter of the outlet.

It should be evident that the pump construction and manufacture of the present invention remain of a simple nature, as was the case with the embodiments of the above-referenced application. The pump is extremely versatile and can function in various positions, such as horizontal, vertical or even inverted if so desired. It can be vertically reciprocal, actuated by trigger mechanism, or as shown, directly, with the discharge nozzle movable or stationary. The diameter of the pump cylinder 18 and piston 20 may be increased so as to be able to disperse a given large volume by a short stroke when coupled with a trigger mechanism providing an acceptable mechanical advantage.

As explained, the position of the sealing rings 40, 46 and 48 can be adjusted to vary the ratio of air to product depending on the purpose sought to be achieved. Ring position will also govern the strength of the suction or negative pressure formed in the pump chamber 44 during the filling cycle as well as the compression available for dispensing the product during the compression cycle. As will be appreciated by those skilled in the art, piston sealing ring placement and spacing, piston and cylinder port spacing and size, and piston lateral passageway location and size will vary depending on many factors, including avoidance of liquid lock and vapor lock, duration and amount of product dispensed with each stroke, venting and of course, the desired sealing against leakage.

Reference is made of FIGS. 13 to 15 showing a skeletonized or streamline design of a trigger actuated pump, in which the pump 16' may be identical with the pump 16, but is actuated by means of a trigger 70 with an adequate mechanical advantage so that the desirable finger pressure may be utilized to move the piston through the compression stroke. Normally, the finger pressure for acceptable manipulation is approximately 2 to 3 pounds of pulling force. As shown, the outlet port 26' leads to a laterally extending discharge orifice 28' for convenience of application of the product being pumped. Where desired and depending upon marketing and/or consumer preference, a suitable shroud may overlie the skeletonized unit of this embodiment and be secured in place in a manner well known to those skilled in the art. In this manner, many different exterior pump appearances are possible with basically the same pump design. Shiftable pin 72 advantageously closes and seals the outlet port 26' particularly during shipping and storage and opens this port when product is to be dispensed. Of course, the extent to which this port is opened may be varied. The location of this shiftable pin 72 separate from the discharge nozzle 28' permits more latitude in the design of this nozzle because it need not provide an on-off function.

In FIG. 16, details of a preferred shiftable pin 72 are disclosed in which the pin is axially shiftable from a closed position to an open position. Although this may be done manually, it is of extreme importance that provisions are made to have this plug automatically shift to an open position from a closed position upon priming the trigger and pressurizing the pump chamber.

In FIG. 17, a rotatable pin 72' is shown which need only be twisted between open and closed positions.

In FIGS. 18 and 19, a rotatable nozzle 74 is disclosed for permitting the discharge direction from the pump of this invention to be adjusted by the consumer.

The pump of the present invention advantageously permits the handling of petroleum based and aggressive products. In this connection, the pump may be designed with predetermined sealing rings and port placement for very aerated products to unaerated products.

An important advantage of the present invention is that as a result of the segmentation of the sealing rings on their respective ring sleeves, new or another set of tooling is not necessary for purposes of changing air to product ratios thereby permitting the use of the same basic pump with different products. Towards this end, only the location of the sealing rings will be changed to accommodate the different products or to obtain a different air product ratio.

As used throughout, the term "ring" is intended to cover all sealing elements, the shape of which will be dependent upon the transverse cross-section of the tubular pump, whether it be circular, elliptical, straight-sided or other geometrical form. Likewise, the term "cylinder" is intended to embrace these cross-sectional configurations of tubes within which the piston is reciprocal.

Thus, the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A dispensing pump system for dispensing product from a container, the pump serving as a container closure, comprising:

an outer cylinder having a forward closed end and a rear open end;

an inner piston in the outer cylinder defining a pump chamber therewith, and the cylinder and piston being relatively reciprocal through a compression stroke from an extended position to an inserted position and through a suction stroke from the inserted position to the extended position;

inlet port means for communicating the container interior with the pump chamber during part of the suction stroke to permit product to be drawn into the pump chamber from the container interior due to a negative pressure differential created between the pump chamber and the container interior;

a dip tube forming part of the inlet port means for directing product from the container interior into the pump chamber;

outlet port means for product to be dispensed under pressure from the pump during the compression stroke;

venting means for replacing product removed from the container interior into the pump chamber with air;

the inlet and outlet port means being spaced from each other along the axis of the cylinder and piston and sequentially opening and closing as a consequence of and during the relative reciprocation of the piston and cylinder during the pumping cycle to permit product to enter the pump chamber and dispense from the pump chamber, the inlet port means being closer to the forward end of the cylinder while the outlet port means being closer to the rear open end of the cylinder;

sealing rings being interposed between the cylinder and the piston and axially spaced from one another in a predetermined manner and in relation to the inlet port means and the outlet port means;

at least three spaced sealing rings being provided, a third ring closer to the rear end for sealing the juncture between the piston and cylinder and being at all times interposed between the outlet port means and the open end of the cylinder, a first ring closer to the forward end of the cylinder for opening and closing the inlet port means from the pump chamber and when the piston and cylinder are in the extended position the first ring is interposed between the inlet port means and the outlet port means, and a second ring intermediate the first and third ring and adapted to close the outlet port means from the pump chamber before the first ring opens the inlet port means to the pump chamber during the suction stroke, the piston having a longitudinal passage and a transverse passage;

means for drawing air into the pump chamber through the outlet port means during the initial portion of the suction stroke; and maximum volume of air entering the pump chamber being limited to the volume defined by the internal cross-sectional area of the cylinder times the distance between the second ring and the outlet port means measured at the start of the suction stroke while the first ring maintains the inlet port means closed, the minimum amount of product sucked into the pump chamber with each suction stroke of the piston being related to the cross-sectional area of the cylinder times the length of piston travel in the cylinder after the second ring has passed and closed the outlet port means, the amount of product available for discharge during the compression stroke out through the outlet port means being the amount of product that was actually sucked into the pump chamber minus the amount of product returned to the container through the inlet port means during the compression stroke before the inlet port means is closed by the first ring.

2. The invention in accordance with claim 1, wherein the dispensing pump includes a trigger means coupled with the piston for actuating the piston and causing its reciprocation in the cylinder during the compression stroke and suction stroke.

3. The invention in accordance with claim 1, wherein cooperating passages are defined between the cylinder and piston to permit the product in the pump chamber to be directed out through the outlet port means during the compression stroke.

4. The invention in accordance with claim 1, wherein a return spring means biases the piston and the cylinder to their extending position.

5. The invention in accordance with claim 4, wherein the return spring means is within the cylinder and interposed between the piston and cylinder.

6. The invention in accordance with claim 1, wherein during the suction stroke air is sucked through the outlet port means from the ambient into the pump chamber to purge product from the outlet port means thereby rendering the pump system self-cleaning during each pump cycle to prevent clogging of product in the outlet port means.

7. The invention in accordance with claim 1, wherein the venting means includes cooperating passages that permit air to be directed from the outlet port means into the container interior during reciprocation of the piston.

8. The invention in accordance with claim 1, wherein each ring has a base and tapering to an outer edge, each ring being inclined defining an acute angle with the axis of the piston so that the rings resist any tendency to collapse during the compression stroke.

9. The invention in accordance with claim 1, wherein the distance between the second ring and the outlet port at the start of the suction stroke being made less than the actual piston stroke from the fully inserted position to the extended position.

10. The invention in accordance with claim 1, wherein the sealing rings are on the piston.

11. The invention in accordance with claim 1, wherein each ring extends from a sleeve separate from the other sleeves and in telescoping relation on the piston.

12. A dispensing pump system for dispensing product from a container comprising:

a cylinder defining an outer part and having a forward closed end and a rear open end;

a piston defining an inner part in the cylinder and defining a pump chamber therewith, and the piston and cylinder being relatively reciprocal through a compression stroke from an extended position to an inserted position and through a suction stroke from the inserted position to the extended position;

inlet port means in the cylinder for communicating the container interior with the pump chamber during part of the suction stroke to permit product to be drawn into the pump chamber from the container interior due to a negative pressure differential created between the pump chamber and the container interior;

a dip tube forming part of the inlet port means for directing product from the container interior into the pump chamber;

a separate outlet port means in one of the parts for product to be dispensed under pressure from the pump chamber during the compression stroke;

the inlet and outlet port means being spaced from each other along the axis of the cylinder and piston and sequentially opening and closing as a consequence of and during the relative reciprocation of the piston and cylinder during the pumping cycle to permit product to enter the pump chamber and dispense from the pump chamber, the inlet port means being closer to the forward end of the cylinder while the outlet port means being closer to the rear open end of the cylinder;

means for drawing air into the pump chamber through the outlet port means during the initial portion of the suction stroke thus purging product from the outlet port means thereby rendering the pump system self-cleaning during each pump cycle to prevent clogging of product in the outlet port means;

venting means provided by cooperating surfaces of the piston and cylinder for replacing product removed from the container interior into the pump chamber with air;

sealing rings being interposed between the cylinder and the piston and axially spaced from one another in a predetermined manner and in relation to the inlet port means and the outlet port means;

at least three spaced sealing rings being provided, a third ring closer to the open end for sealing the juncture between the piston and cylinder and being at all times interposed between the outlet port means and the open end of the cylinder, a first ring closer to the closed end of the cylinder for opening and closing the inlet port means from the pump chamber and when the piston and cylinder are in the extended position the first ring is interposed between the inlet port means and the outlet port means, and a second ring intermediate the first and third ring and adapted to close the outlet port means from the pump chamber before the first ring opens the inlet port means to the pump chamber during the suction stroke, the piston having a longitudinal passage and a transverse passage;

the transverse passage being between the third and second ring and communicating directly with the longitudinal passage and, during portions of the compression and suction strokes, with a stationary outlet orifice forming part of the outlet port means;

the first and third rings being spaced apart a distance exceeding the distance between the inlet and outlet port means and said outlet port means communicating with the vent means to vent the container when the first ring is interposed between the vent means and the closed end of the cylinder and the second ring is on the side of the outlet port means closest to the open end of the cylinder; and means for drawing air into the pump chamber through the outlet port means during the initial portion of the suction stroke; the maximum volume of air entering the pump chamber being limited to the volume defined by the internal cross-sectional area of the cylinder times the distance between the second ring and the outlet port means measured at the start of the suction stroke while the first ring maintains the inlet port means closed, the minimum amount of product sucked into the pump chamber with each suction stroke of the piston being related to the cross-sectional area of the cylinder times the length of piston travel in the cylinder after the second ring has passed and closed the outlet port means and the inlet port means has been opened minus the volume of air drawn into the pump chamber, the amount of product available for discharge during the compression stroke out through the outlet port means being the amount of product that was actually sucked into the pump chamber minus the amount of product returned to the container through the inlet port means during the compression stroke before the inlet port means is closed by the first ring.

13. A dispensing pump for dispensing product from a container comprising:

a cylinder defining an outer part and having a forward closed end and a rear open end;

a piston defining an inner part and defining a pump chamber therewith, and the piston and cylinder being relatively reciprocal through a compression stroke from an extended position to an inserted position and through a suction stroke from the inserted position to the extended position;

inlet port means for communicating the container interior with the pump chamber during part of the suction stroke to permit product to be drawn into the pump chamber from the container interior due to a negative pressure differential created between the pump chamber and the container interior;

a dip tube forming part of the inlet port means for directing product from the container interior into the pump chamber;

a separate outlet port means in one of the parts for product to be dispensed under pressure from the pump chamber during the compression stroke, the inlet and outlet port means being spaced from each other along the axis of the cylinder and piston and sequentially opening and closing as a consequence of and during the relative reciprocation of the piston and cylinder during the pumping cycle to permit product to enter the pump chamber and dispense from the pump chamber, the inlet port means being closer to the forward end of the cylinder while the outlet port means being closer to the rear open end of the cylinder;

air assist means for assuring the presence of a predetermined quantity of air in the pump chamber to assist in the dispensing of the product from the pump chamber through the outlet port means;

venting means provided by cooperating surfaces of the piston and cylinder for replacing product removed from the container interior into the pump chamber with air;

sealing rings being interposed between the cylinder and the piston and axially spaced from one another in a predetermined manner and in relation to the inlet port means and the outlet port means;

at least three axially spaced sealing rings being provided, a third ring closer to the open end for sealing the juncture between the piston and cylinder and being at all times interposed between the outlet port means and the open end of the cylinder, a first ring closer to the closed end of the cylinder for opening and closing the inlet port means from the pump chamber and when the piston and cylinder are in the extended portion the first ring is interposed between the inlet port means and the outlet port means, and a second ring intermediate the first and third ring and adapted to close the outlet port means from the pump chamber before the first ring opens the inlet port means to the pump chamber during the suction stroke, the piston having a longitudinal passage and a transverse passage; and the maximum volume of air entering the pump chamber due to the operation of the air assist means is limited to the volume defined by the internal cross-sectional area of the cylinder times the distance between the second ring and the outlet port means measured at the start of the suction stroke while the first ring maintains the inlet port means closed, the minimum amount of product sucked into the pump chamber with each suction stroke of the piston being realted to the cross-sectional area of the cylinder times the length of piston travel in the cylinder after the second ring has passed and closed the outlet port means, the amount of product available for discharge during the compression stroke out through the outlet port means being the amount of product that was actually sucked into the pump chamber minus the amount of product returned to the container through the inlet port means during the compression stroke before the inlet port means is closed by the first ring.

14. The invention in accordance with claim 13, wherein the cylinder has a port forming part of the inlet port means communicating with the container interior and wherein the piston is hollow and includes a means for communicating the hollowed portion of the piston with the piston's interior so that during the suction stroke the pump chamber communicates with the outlet port means in drawing the product back into the pump chamber to purge the outlet port means and thereafter the product is adapted to pass directly into the pump chamber from the cylinder port when the cylinder port communicates directly with the pump chamber.

15. The invention in accordance with claim 13, wherein the dispensing pump includes a trigger means coupled with the piston for actuating the piston and causing its reciprocation in the cylinder during the compression stroke and suction stroke.

16. A dispensing pump for dispensing product from a container comprising:

an outer cylinder having a forward closed end and a rear open end;

an inner piston in the outer cylinder defining a pump chamber therewith, and the cylinder and piston being relatively reciprocal through a compression stroke by insertion from an extended position to an inserted position and through a suction stroke by retraction from the inserted position to the extended position;

a dip tube forming part of the inlet port means for directing product from the container interior into the pump chamber;

inlet port means for communicating the container interior with the pump chamber during part of the suction stroke to permit product to be drawn into the pump chamber from the container interior due to a negative pressure differential created between the pump chamber and the container interior;

outlet port means for product to be dispensed under pressure from the pump chamber during part of a compression stroke;

the inlet and outlet port means being spaced from each other along the axis of the cylinder and piston and sequentially opening and closing as a consequence of and during the relative reciprocation of the piston and cylinder during the pump cycle to permit product to enter the pump chamber and dispense from the pump chamber, the inlet port means being closer to the forward end of the cylinder while the outlet port means being closer to the rear open end of the cylinder;

the inlet and outlet port means being so constructed, spaced and arranged relative to one another and the piston that during a predetermined part of the suction stroke and retraction of the piston, both the inlet and outlet port means are closed by the piston and during this predetermined part of the retraction of the piston a preselected negative pressure is created in the pump chamber which upon opening of the inlet port means upon further retraction of the piston acts to suck product into the pump chamber through the inlet port means proportional to said preselected negative pressure;

sealing rings being interposed between the cylinder and the piston and axially spaced from one another in a predetermined manner and in relation to the inlet port means and the outlet port means, at least three spaced sealing rings being provided, a third ring closer to the piston rear end for sealing the juncture between the piston and cylinder and being interposed at all times between the outlet port means and the open end of the cylinder; a first ring closer to the forward end of the cylinder for opening and closing the inlet port means from the pump chamber and when the piston and cylinder are in the extended position the first ring is interposed between the inlet port means and the outlet port means, and a second ring intermediate the first and third rings adapted to close the outlet port means from the pump chamber before the first ring opens the inlet port means to the pump chamber during the suction stroke, the second ring adapted to maintain the outlet port means closed and the first ring adapted to maintain the inlet port closed during the predetermined part of the suction stroke and retraction of the piston to generate the preselected negative pressure.

17. The invention in accordance with claim 16, wherein means are provided for drawing air into the pump chamber djuring the suction stroke to provide enough air in the pump chamber for compression during the compression stroke while both the inlet port means and outlet port means are closed before the outlet port means opens during insertion of the piston.

18. The invention in accordance with claim 17, wherein air resistance means are provided between the pump chamber and ambient through the outlet port means, for creating additional negative pressure in the pump chamber during retraction of the piston when the outlet port means is open and the inlet port means is closed.

19. The invention in accordance with claim 17, wherein the inlet port means and the outlet port means are so constructed, spaced and arranged to provide a predetermined product to air ratio within the pump chamber.

20. The invention in accordance with claim 16, wherein the inlet and outlet port means being so constructed, spaced and arranged relative to one another and the piston that during a predetermined part of the compression stroke and insertion of the piston, both the inlet and outlet port means are closed and during this predetermined part of the insertion of the piston a preselected positive pressure is created in the pump chamber which upon opening of the outlet port means upon further insertion of the piston acts to force product out of the pump chamber through the outlet port means proportional to said preselected positive pressure.

21. The invention in accordance with claim 16, wherein venting means are provided for replacing product removed from container interior into the pump chamber with air.

22. The invention in accordance with claim 16, wherein the first and third rings are spaced apart a distance exceeding the distance between the inlet and outlet port means.

23. The invention in accordance with claim 16, wherein vent means are provided for replacing product removed from the container interior into the pump chamber with air, the outlet port means communicating with the vent means to vent the container when the first ring is interposed between the vent means and the closed end of the cylinder and the second ring is on the side of the outlet port means closest to the open end of the cylinder.

24. The invention in accordance with claim 23, wherein a fourth ring is disposed between the vent means and the outlet port means when the piston is in the fully extended position to seal the vent means from the outlet port means.

25. The invention in accordance with claim 16, wherein the piston has an axis each ring has a base and tapers to an outer edge, each ring being inclined defining an acute angle with the axis of the piston so that the rings resist any tendency to collapse during the compression stroke.

26. The invention in accordance with claim 16, wherein the dispensing pump includes a trigger means coupled with the piston for actuating the piston and causing its reciprocation in the cylinder during the compression stroke and suction stroke.

27. The invention in accordance with claim 16, wherein during the suction stroke air is sucked through the outlet port means from the ambient into the pump chamber to purge product from the outlet port means thereby rendering the pump system self-cleaning during each pump cycle to prevent clogging of product in the outlet port means.

28. The invention in accordance with claim 16, wherein each ring extends from a sleeve separate from the other sleeves and in telescoping relation on the piston.

29. The invention in accordance with claim 16, wherein the cylinder has a port forming part of the inlet port means communicating with the container interior and wherein the piston is hollow and includes lateral walls and at least one port in the lateral walls thereof extending from the exterior to the interior of the piston, and during the suction stroke the piston port being adapted to communicate with the outlet port means in drawing the product back into the pump chamber to purge the outlet port means and thereafter the product is adapted to pass directly into the pump chamber when the cylinder port communicates directly with the pump chamber.

30. A pump for dispensing product according to claim 16 in which a discharge orifice means dispenses the product in a predetermined discharge pattern, a passage interconnecting the outlet port means and the discharge orifice means, and pin means manually shiftable out of and into the passage between an open position at which the passage is open and a closed position at which the passage is closed, respectively.

31. The invention in accordance with claim 30, wherein the pin means is manually axially shiftable between the open and closed position.

32. The invention in accordance with claim 31, wherein the pin means is automatically shiftable to the open position from the closed position during the compression stroke of the pump.

33. The invention in accordance with claim 31, wherein retention means are provided for releasably retaining the pin means in the open and closed position.

34. The invention in accordance with claim 30, wherein the pin means is rotatable between the open and closed position.

35. A versatile universal pump construction utilizing minimum basic parts while permitting with these same parts a wide variety of product discharge characteristics comprising:

a cylinder having an open rear end and a forward closed end;

a piston in the cylinder and having a forward end and a rear end and defining with the cylinder a variable volume pump chamber, the piston and cylinder being relatively reciprocal between inserted and extended positions through a suction stroke and a compression stroke;

an inlet means for cooperating with the piston in drawing product into the pump chamber;

an outlet means being spaced from the inlet means along the axis of the cylinder and piston for cooperation with the piston in directing product under pressure out of the pump chamber, the inlet means being closer to the forward end of the cylinder while the outlet means being closer to the rear open end of the cylinder.

sealing ring means interposed between the piston and cylinder and being adjustable axially relative thereto for attaining a predetermined product discharge characteristic for the pump, the sealing ring means includes at least one sleeve and an integral ring extending outwardly therefrom and means for permitting the sleeve to be axially shiftable relative to the piston and cylinder and consequently relative to the inlet means and outlet means for attaining the predetermined product discharge characteristic;

three of the ring means being interposed between the piston and cylinder and axially spaced from each other, a third ring means closer to the piston rear end for sealing the juncture between the piston and cylinder and being at all times interposed between the outlet port means and the open end of the cylinder; a first ring means closer to the forward end of the cylinder for opening and closing the inlet port means from the pump chamber and when the piston and cylinder are in the suction stroke the first ring means is interposed between the inlet port means and the outlet port means, and a second ring means intermediate the first and third ring means adapted to close the outlet port means before the first ring means opens the inlet port means to the pump chamber during the suction stroke, the second ring means adapted to maintain the outlet port means closed and the first ring means adapted to maintain the inlet port closed during a predetermined portion of the suction stroke to generate a preselected negative pressure.

36. The invention in accordance with claim 35, wherein the first and third rings are spaced apart a distance exceeding the distance between the inlet and outlet port means.

37. The invention in accordance with claim 35, wherein the pump construction is adapted to be mounted on a container containing the product, vent means are provided for replacing product removed from the container into the pump chamber with air, the outlet port means communicating with the vent means to vent the container when the first ring is interposed between the vent means and the closed end of the cylinder and the second ring is on the side of the outlet port means closest to the open end of the cylinder.

38. The invention in accordance with claim 35, wherein a fourth ring is disposed between the vent means and the outlet port means when the piston is in a fully extended position to seal the vent means from the outlet port means.

39. The invention in accordance with claim 35, wherein the piston has an axis, each ring has a base and tapers to an outer edge, each ring being inclined defining an acute angle with the axis of the piston so that the rings resist any tendency to collapse during the compression stroke.

40. The invention in accordance with claim 35, wherein a rotatable nozzle is in fluid communication with the outlet means for permitting the consumer to adjust the direction of discharge of product and means for rotatably coupling the nozzle to the pump.

41. The invention in accordance with claim 35, wherein a discharge nozzle is coupled with the outlet means and a shiftable pin interposed between the discharge nozzle and pump chamber.

* * * * *